US009933225B2

(12) United States Patent
Yehle et al.

(10) Patent No.: US 9,933,225 B2
(45) Date of Patent: Apr. 3, 2018

(54) BIPOD WITH A QUICK CONNECT FEATURE FOR STANDARD RAILS

(71) Applicant: Ravin Crossbows, LLC, Superior, WI (US)

(72) Inventors: Craig Thomas Yehle, Winona, MN (US); Fred Hunt, Athol, ID (US)

(73) Assignee: Ravin Crossbows, LLC, Superior, WI (US)

( * ) Notice: Subject to any disclaimer, the term of this patent is extended or adjusted under 35 U.S.C. 154(b) by 0 days.

(21) Appl. No.: 15/433,746

(22) Filed: Feb. 15, 2017

(65) Prior Publication Data

US 2017/0248385 A1 Aug. 31, 2017

Related U.S. Application Data

(60) Provisional application No. 62/299,808, filed on Feb. 25, 2016.

(51) Int. Cl.
*F41A 23/10* (2006.01)

(52) U.S. Cl.
CPC ..... *F41A 23/10* (2013.01)

(58) Field of Classification Search
CPC ..... F41A 23/14; F41A 23/12; F41A 23/10; F41A 23/08; F41A 23/06; F41A 23/04; F41A 23/02
USPC ..... 42/85, 90, 94; 89/37.01, 37.04, 37.03, 89/40.06
See application file for complete search history.

(56) References Cited

U.S. PATENT DOCUMENTS

| | | | | |
|---|---|---|---|---|
| 1,128,248 | A * | 2/1915 | Hetzel | B05B 15/062 248/85 |
| 3,235,997 | A * | 2/1966 | Stoner | F41A 23/08 42/94 |
| 3,235,998 | A * | 2/1966 | Hadley | F41A 23/08 42/94 |
| 4,397,112 | A * | 8/1983 | York | F41A 23/08 42/94 |
| D346,636 | S * | 5/1994 | Bechtel | D22/108 |
| D406,302 | S * | 3/1999 | Simpson | D22/100 |
| 6,070,569 | A | 6/2000 | Chalin et al. | |
| 6,283,875 | B1 * | 9/2001 | Jones | A63B 55/10 211/70.2 |
| 6,763,627 | B1 | 7/2004 | Kaempe | |
| 7,032,494 | B2 | 4/2006 | Wygant | |

(Continued)

OTHER PUBLICATIONS

X-Factor Bow Stand webpage http://www.xfactoroutdoors.com/_p/prd1/2309484621/product/x-factor-bow-stand.

(Continued)

*Primary Examiner* — John Cooper

(57) ABSTRACT

A bipod with a quick connect feature that engages with a standard rail. The bipod includes a pair legs pivotally attached at a pivot axis. A biasing mechanism is coupled to the legs that has a dead center position when the legs are in an intermediate configuration between a deployed configuration and a collapsed configuration. By shifting the biasing mechanism to one side or the other, the legs are automatically deployed to either the deployed configuration or the collapsed configuration. The biasing mechanism maintains the interface with the rail when in the deployed configuration and retains the lower portions of the legs adjacent each other in the collapsed configuration.

20 Claims, 17 Drawing Sheets

(56) References Cited

U.S. PATENT DOCUMENTS

| | | | | |
|---|---|---|---|---|
| 7,121,034 | B2 * | 10/2006 | Keng | F41A 23/10 42/71.01 |
| 7,197,844 | B2 * | 4/2007 | Benson | F41A 23/08 248/593 |
| 7,222,451 | B2 * | 5/2007 | Keng | F41A 23/08 42/127 |
| 7,380,486 | B1 * | 6/2008 | Bean | F41A 23/08 42/94 |
| 7,490,429 | B2 * | 2/2009 | Moody | F41A 23/08 248/171 |
| 7,506,846 | B2 | 3/2009 | Speggiorin | |
| 7,631,455 | B2 * | 12/2009 | Keng | F16M 11/10 248/163.1 |
| 7,770,320 | B1 | 8/2010 | Bartak | |
| 7,779,572 | B2 | 8/2010 | Potterfield et al. | |
| 7,845,002 | B1 | 12/2010 | Young et al. | |
| 8,104,213 | B2 * | 1/2012 | Keng | F41A 23/10 42/94 |
| 8,161,956 | B2 * | 4/2012 | Bednar | F41B 5/123 124/25 |
| 8,448,369 | B2 * | 5/2013 | Hinds, Jr. | F41A 23/08 42/94 |
| 8,458,946 | B1 * | 6/2013 | Pintsch | F41A 23/08 42/90 |
| 8,496,212 | B2 * | 7/2013 | Keng | F41A 23/10 211/203 |
| 8,596,597 | B1 * | 12/2013 | Spicer | F16M 11/38 15/230.11 |
| 8,863,430 | B2 | 10/2014 | Poling | |
| 8,882,070 | B2 * | 11/2014 | Bean | F41B 5/14 248/216.1 |
| 8,904,693 | B1 * | 12/2014 | Beltz | F41A 23/10 42/72 |
| 9,285,075 | B2 * | 3/2016 | Moody | F41A 23/08 |
| 9,568,270 | B1 * | 2/2017 | LoRocco | F41B 5/1453 |
| 2003/0042388 | A1 * | 3/2003 | Peterson | F16M 11/26 248/440.1 |
| 2005/0188596 | A1 * | 9/2005 | Wygant | F41A 23/08 42/94 |
| 2012/0186126 | A1 | 7/2012 | Bartak | |
| 2017/0248385 | A1 * | 8/2017 | Yehle | F41A 23/10 |

OTHER PUBLICATIONS

TruGlo Bow Jack folding bow stand brochure http://www.truglo.com/archery-bow-accessories/bow-jack.asp.

* cited by examiner

BIPOD WITH A QUICK CONNECT FEATURE FOR STANDARD RAILS

REFERENCE TO RELATED APPLICATIONS

The present application claims the benefit of U.S. Prov. Application Ser. No. 62/299,808, filed Feb. 25, 2016, entitled Bipod with a Quick Connection Feature for Standard Rails the entire disclosure of which is hereby incorporated by reference.

FIELD OF THE INVENTION

The present disclosure is directed to a bipod for a shooting device with a quick connect feature for standard rails and a biasing mechanism that includes a dead center position. In a dead center position the biasing mechanism does, not advance the legs to either a deployed configuration or a collapsed, configuration. The user merely displaces the biasing mechanism slightly off the dead center position and the legs automatically open or close, as desired. The biasing mechanism maintains the interface with the rail when in the deployed configuration and retains the lower portions of the legs adjacent each other in the collapsed configuration.

BACKGROUND OF THE INVENTION

Bipods are known for use with shooting devices which can be designed specifically for hunting, target practice, war games, etc. These Bipods can greatly improve the accuracy of the shooter by providing a stabilizing support for the shooting device. Bipods can be used while the shooter is sitting, kneeling or even standing if there is a raised platform to support the bipod. Bipods can also be used when the shooter is stalking or tree stand hunting.

Bipods are known which attach to a threaded sling receiver using a sling stud. However, these Bipods require that the sling be removed from the shooting device, at least at the threaded sling receiver, and be replaced with the bipod. While the shooting, device is more convenient to shoot, it is less convenient to carry, and activities such as hunting and war games typically require both convenient carrying and shooting. Also, the threaded sling receiver is part of the shooting device stock, and in modern shooting devices the stock is much shorter than the barrel so that the bipod is located midway along the barrel which is not as stable as a bipod located at or near the end of the barrel. This method also restricts the bipod location to a single position along the stock which may not be the best position particularly when hunting in rough terrain. Further, such a bipod may be limited to use with a single shooting device due to differences in threaded sling receivers and associated bipod compatibility.

Another known method is bipod attachment to a sling swivel. This method is slightly more convenient than attaching the bipod to the threaded sling receiver but has the same disadvantages.

A cradle bipod has the advantages of being able to locate the bipod along a variety of positions along the stock or barrel, can easily adapt to a variety of shooting devices and does not require removal of the sling. However, the cradle bipod has the disadvantage of not positively connecting to the shooting device therefor, particularly when following a moving target, cradle bipods can collapse unless held and even when held may not be stable. When stalking, for example, the cradle bipod will need to be carried which is another disadvantage.

Shooting devices often include a rail according to U.S. military standard MIL-STD-1913 which may provide structure for attachment of accessories, such as bipods. Various types of rail systems, including Picatinny and Weaver rails (referred to herein as "standard rails") are commercially available. Standard rails are long, thin platform having a flattened hexagonal cross section and a series of uniformly shaped and spaced transverse grooves formed along its length with which to attach various devices to the shooting device. A bipod suitable for stock attachment will not typically be suited for rail attachment.

BRIEF SUMMARY OF THE INVENTION

The present disclosure is directed to a bipod for a shooting device with a quick connect/disconnect feature that couples to a standard rails. The present bipod includes a biasing mechanism coupled to the legs. In a dead center position the, biasing mechanism does not advance the legs to either a deployed configuration or a collapsed configuration. With minimal force the user merely displaces the biasing mechanism slightly off the dead center position and the legs automatically open or close.

One embodiment is directed to a bipod with a quick connect feature that engages with a standard rail having a generally flattened hexagonal cross-sectional shape with alternating transverse, grooves and ridges located along an exposed major surface. The bipod includes a pair legs pivotally attached at a pivot axis. Each of the legs has, upper portions and lower portions located on opposite side of the pivot axis. The legs are moveable between a deployed configuration with the lower portions separated; and the upper portions proximate each other, and a collapsed configuration with the lower portions proximate each other and the upper portions separated. U-shaped portions are located at the upper portions of the legs that form an interface with the standard rail when the legs are in a deployed configuration. A biasing mechanism is coupled to the, legs that has a dead center position when the legs are in an intermediate configuration between the deployed configuration and the collapsed configuration. The biasing mechanism does not bias the legs toward either the deployed configuration or the collapsed configuration when in the dead center position, but shifting the biasing mechanism to one side of the dead center position automatically biases the legs toward the deployed configuration, and shifting the biasing mechanism to an opposite side of the dead center position automatically biases the legs toward the collapsed configuration. The biasing mechanism maintains the interface with the rail when in the deployed configuration and retains the lower portions of the legs adjacent each other in the collapsed configuration.

The bipod optionally includes at least one rail groove engagement members located at the interface that couples with one or more transverse grooves in the standard rail. In one embodiment at least one rail groove engagement member is biased into the interface to engage with a transverse groove in the standard rail members. When compressed, the at least one rail groove engagement member is preferably positioned flush with a lower surface of the interface. In use, the user snaps the bipod onto the rail and then shifts the bipod slightly forward or rearward until the rail groove engagement member snaps into the transverse groove.

In another embodiment, the bipod includes at least one recess in one of the upper portions of the legs adjacent the interface with at least one rail groove engagement member located in the recess. The rail groove engagement member is biased into the interface to selectively couple with a transverse groove in the standard rail. In one embodiment, the rail groove engagement member is pivotally attached to the upper portion in the recess. The biasing mechanism is preferably integrally formed in the rail groove engagement member. Each of the legs preferably includes a rail groove engagement member.

The U-shaped portions preferably include angled surfaces that correspond to opposing angled side surfaces on a standard rail. The lower portions of the legs are optionally telescopically extendable and/or foldable.

The biasing mechanism typically provides one of a tension force or a compression force to bias the legs from the dead center position to either the deployed configuration or the collapsed configuration. In one embodiment, the biasing mechanism is a cam structure coupled to one leg and a compression member biasing a cam follower against the cam structure coupled to the other leg. The cam structure preferably includes a high point or lobe that, engages with the cam follower when the legs are in the intermediate configuration.

In another embodiment the biasing mechanism includes a spring pivotally attached to the upper portions of each of the legs at attachment points that shift between opposite sides of the pivot axis when in the deployed configuration or the collapsed configuration. The spring provides a first tension force located between the interface and the pivot axis when in the deployed configuration, and a second tension force located on the opposite side of the pivot, axis from the interface when in the collapsed configuration.

In another embodiment, the biasing mechanism includes a spring pivotally attached to the upper portions of each of the legs that provides first and second tension forces along axes that shifts to opposite sides of the pivot axis when in the deployed configuration or the collapsed configuration. The spring provides a first tension force along an axis located between the interface and the pivot axis when in the deployed configuration, and a second tension force along an axis located on the opposite side of the pivot axis from the interface when in the collapsed configuration.

In one embodiment the bipod includes a pair legs pivotally attached at a pivot axis. Each of the legs has upper portions and lower portions located on opposite, side of the pivot axis. The legs are moveable between a deployed configuration with the lower portions separated and the upper portions proximate each other, and a collapsed configuration with the lower portions proximate each other and the upper portions separated. U-shaped portions are located at the upper portions of the legs that form an interface with the standard rail when the legs are in a deployed configuration. A spring is pivotally attached to the upper portions of each of the legs at attachment points that shift between opposite sides of the pivot axis when in the deployed configuration or the collapsed configuration. The spring provides a first tension force located between the interface and the pivot axis when in the deployed configuration and a second tension force located on the opposite side of the pivot axis from the interface when in the collapsed configuration.

DETAILED DESCRIPTION OF THE INVENTION

Figure 1:
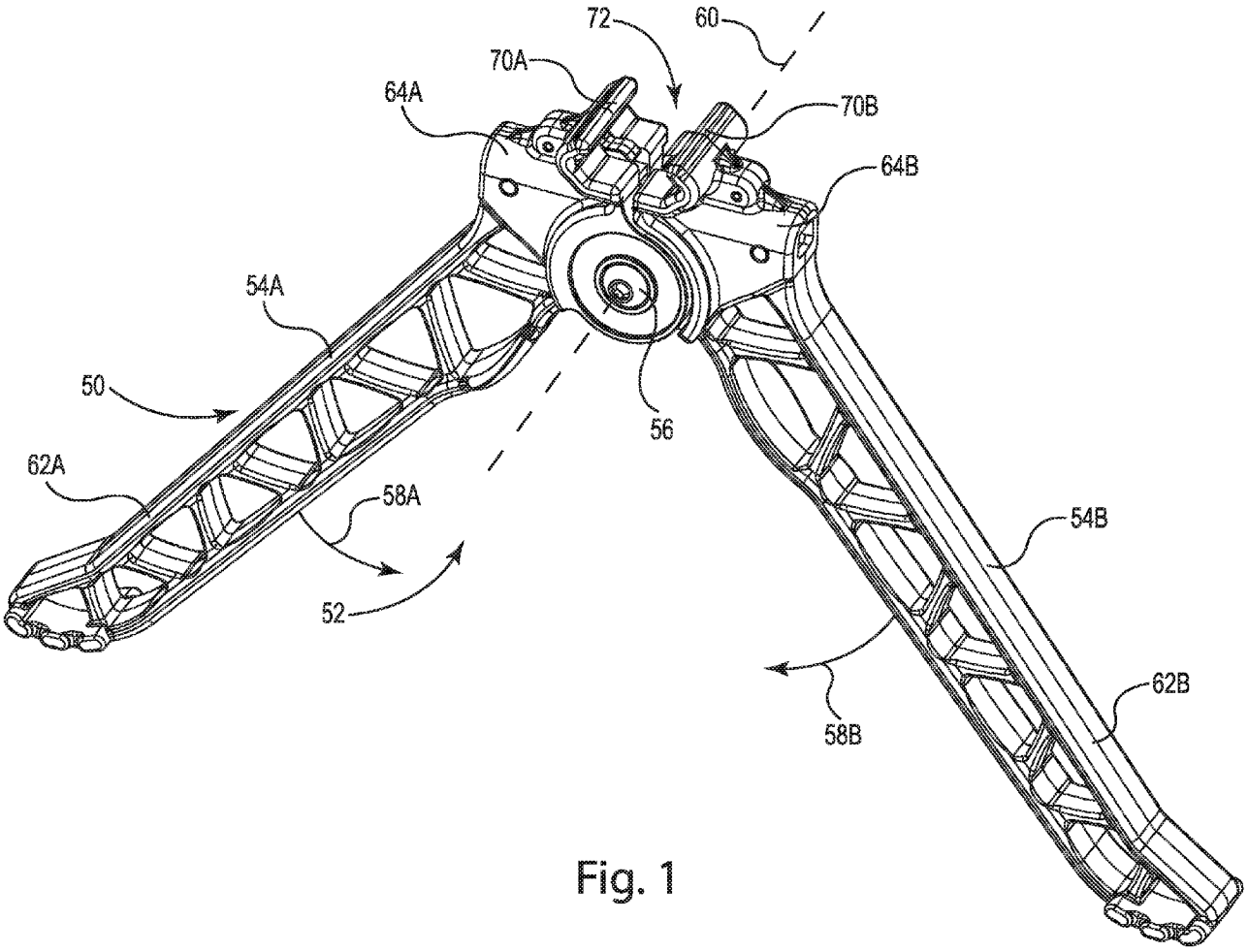
FIG. 1 is a perspective view of a bipod with legs in a deployed configuration in accordance with an embodiment of the present disclosure.
Figure 2A:
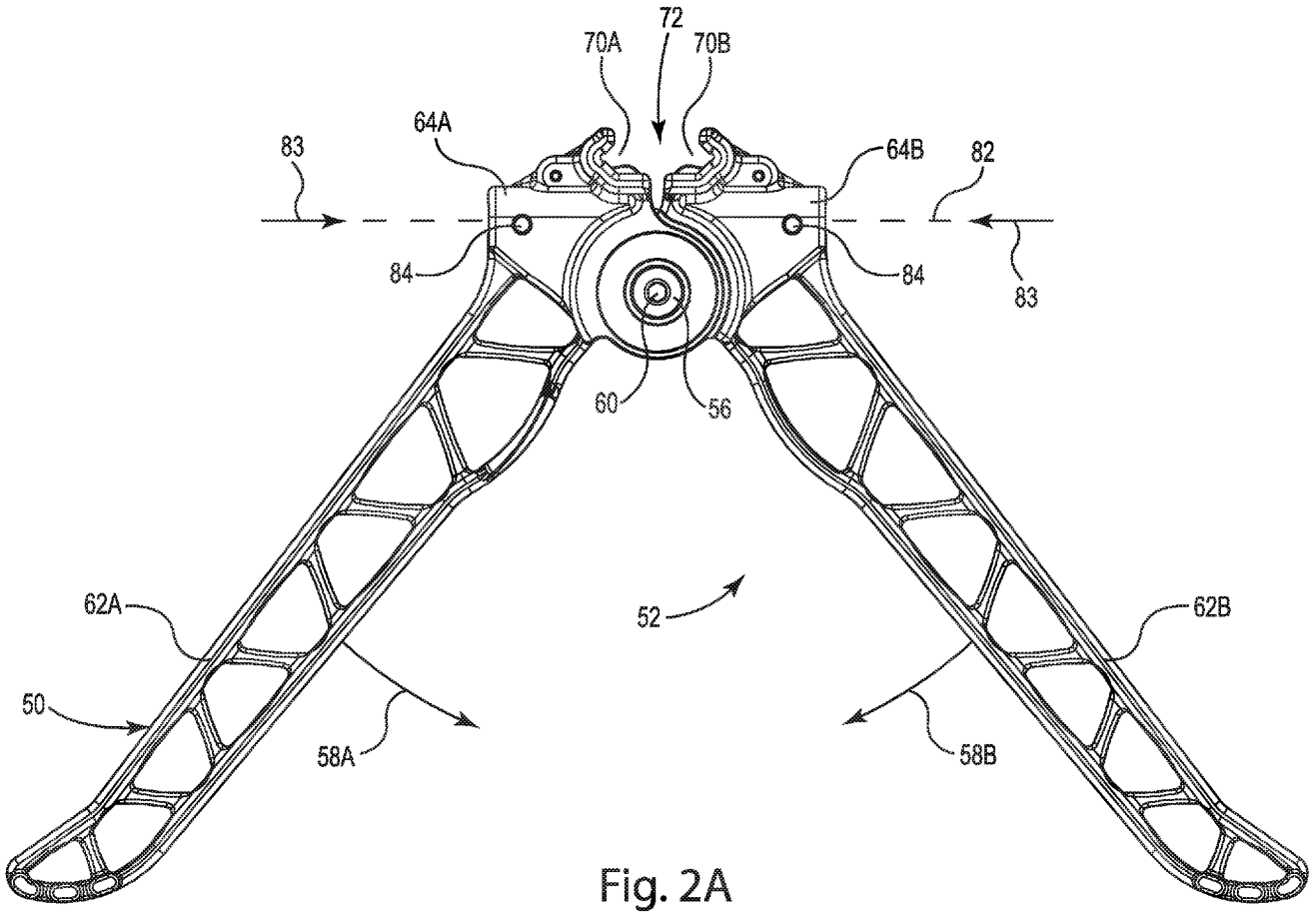
FIG. 2A a front view of the bipod of FIG. 1.

FIGS. 1 through 2A illustrate bipod 50 with legs 54A, 54B ("54") in a deployed configuration 52 in accordance with an embodiment of the present disclosure. The legs 54 are pivotally attached by fastener 56 to pivot around pivot axis 60. The legs 54 rotate in directions 58A, 58B ("58") around the pivot axis 60 to a collapsed configuration 90 illustrated in FIG. 3.

Each of the legs 54 includes lower portions 62A, 62B ("62") and upper portions 64A, 64B ("64"). The lengths 66 (see FIG. 3) of the lower portions 62 can be designed to meet the desired application. Upper portions 64 include opposing U-shaped portions 70A, 70B ("70") that are configure as an interface 72 that grips a standard rail 100 (see FIGS. 5B and 6) when the bipod is in the deployed configuration 52.

Figure 2B:
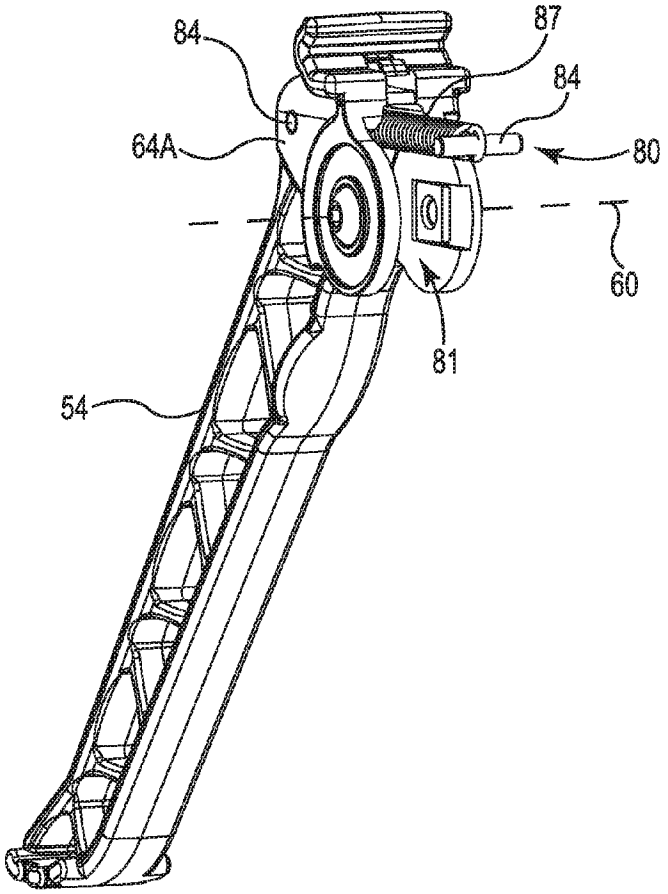
FIG. 2B is a side view of the bipod of FIG. 1 with one leg removed.

FIG. 2B illustrates the bipod 50 with leg 54B removed. In the illustrated embodiment, the upper portions 64 include space 81 that receives biasing mechanism 80. In the illustrate embodiment the biasing mechanism 80 is a spring 87 attached to each of the respective legs 54 by pins 84 that operates primarily in tension. As will be discussed herein, the biasing mechanism can operate in tension, compression, torsion, or a combination thereof (see e.g., FIGS. 10A and 10B). In another embodiment, the biasing mechanism 80 is located on an outside surface of the upper portions 64 and the opening 81 is either reduced in size or unnecessary.

Turning back to FIG. 2A, in the deployed configuration 52 the biasing mechanism 80 acts along the axis 82, which is located between the interface 72 and the pivot axis 60. Consequently, the tension force 83 generated by the biasing mechanism 80 pulls the U-shaped portions 70 toward each other at the interface 72 and into engagement with a standard rail (see FIG. 5B). The tension force 83 of the biasing mechanism 80 also simultaneously maintains the legs 54 in the deployed configuration 52.

Figure 3:
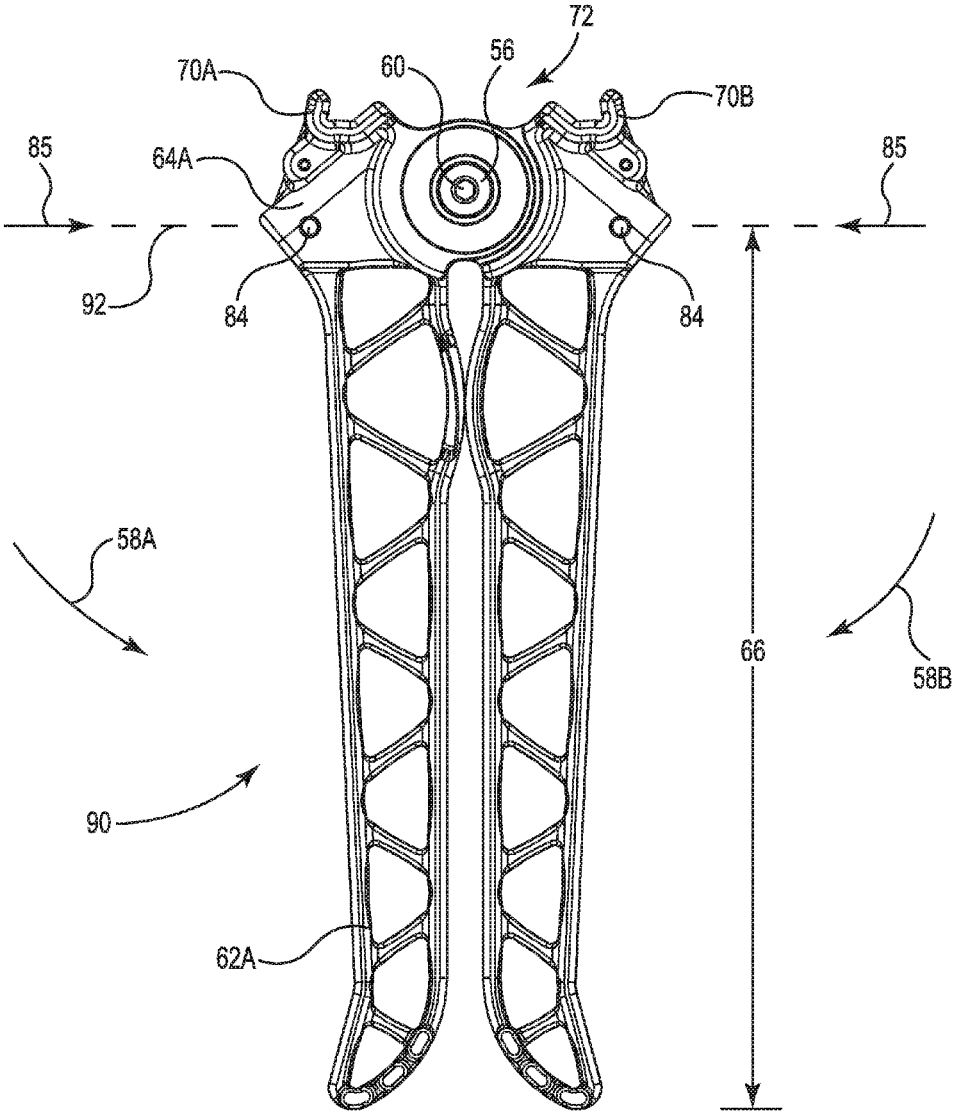
FIG. 3 is a front view of an alternate bipod with the legs in a collapsed configuration in accordance with an embodiment of the present disclosure.

In the collapsed configuration 90 illustrated in FIG. 3, rotation of the legs 54 in the directions 58 shifts the pins 84 below the pivot axis 60 of the fastener 56. The biasing mechanism 80 now acts along axis 92, which is now located below the pivot axis 60 of the fastener 56. In the collapsed configuration 90 the biasing mechanism 80 generates tension force 85 that retains the legs 54 in the collapsed configuration 90 and separates the U-shaped portions 70 to release a rail from the interface 72.

During the transition between the deployed configuration 52 and the collapsed configuration 90 the spring 87 crosses over the pivot, axis 60 and there is no net biasing force toward either the deployed configuration 52 or the collapsed configuration 90. In this position the biasing mechanism 80 is at dead center. The user must provide a small force that moves the biasing mechanism 80 off dead center by displacing the legs toward either the deployed configuration 52 or the collapsed configuration 90. Once done, the biasing mechanism automatically advance the legs to either the deployed configuration 52 or the collapsed configuration 90. As used herein, "dead center" refers to a configuration on a bipod where a biasing force does not bias the legs to either a deployed configuration or a collapsed configuration.

In the illustrated embodiment, dead center occurs when the legs 54 are in an intermediate configuration somewhere between the deployed configuration 52 or the collapsed configuration 90. Once off dead center the biasing mechanism 80 takes over and automatically completes the transition to either the deployed configuration 52 or the collapsed configuration 90, depending on the force applied by the user.

Figure 4A:
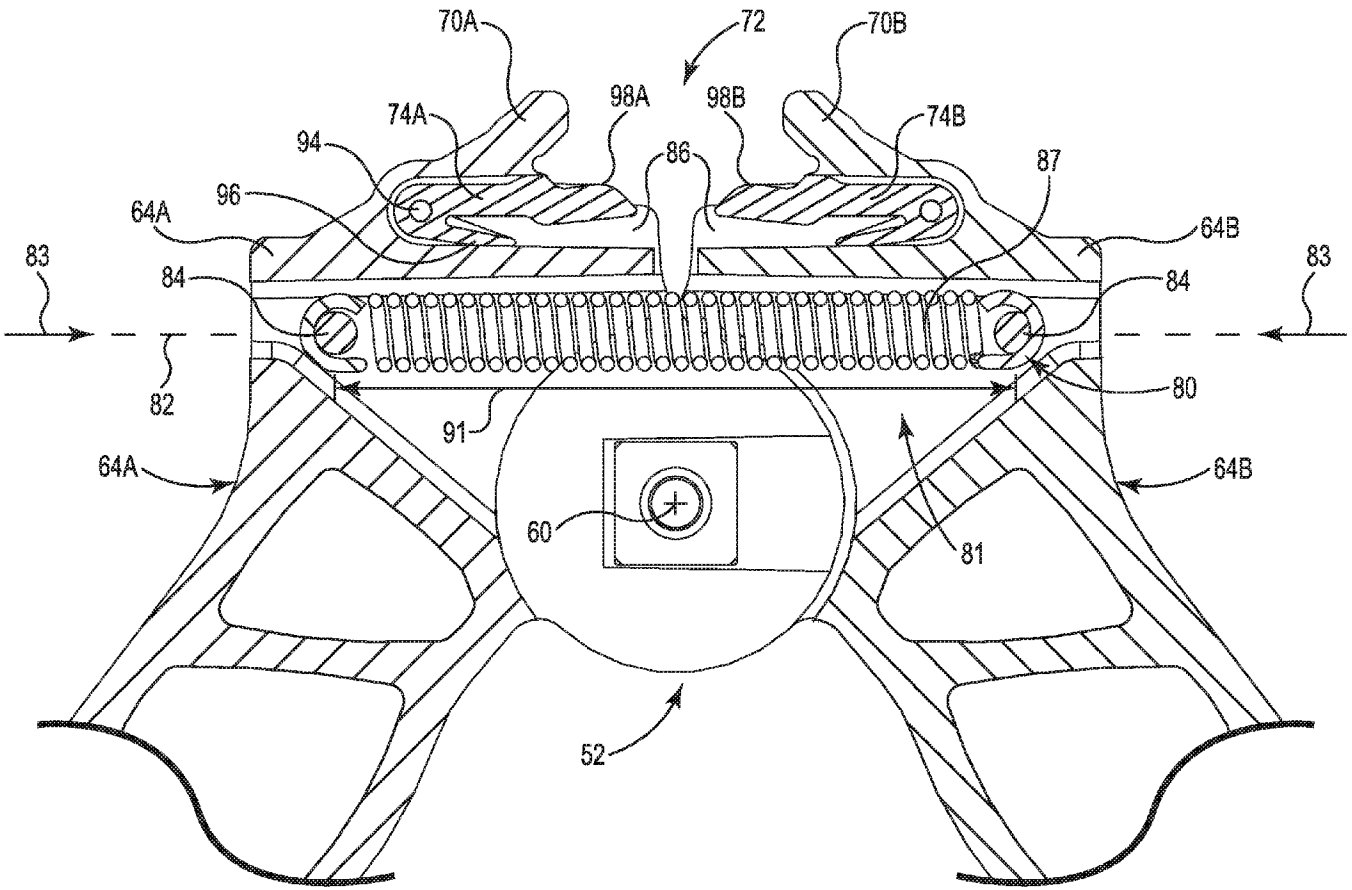
FIGS. 4A and 4B are sectional views of the bipod of FIG. 1.
Figure 4B:
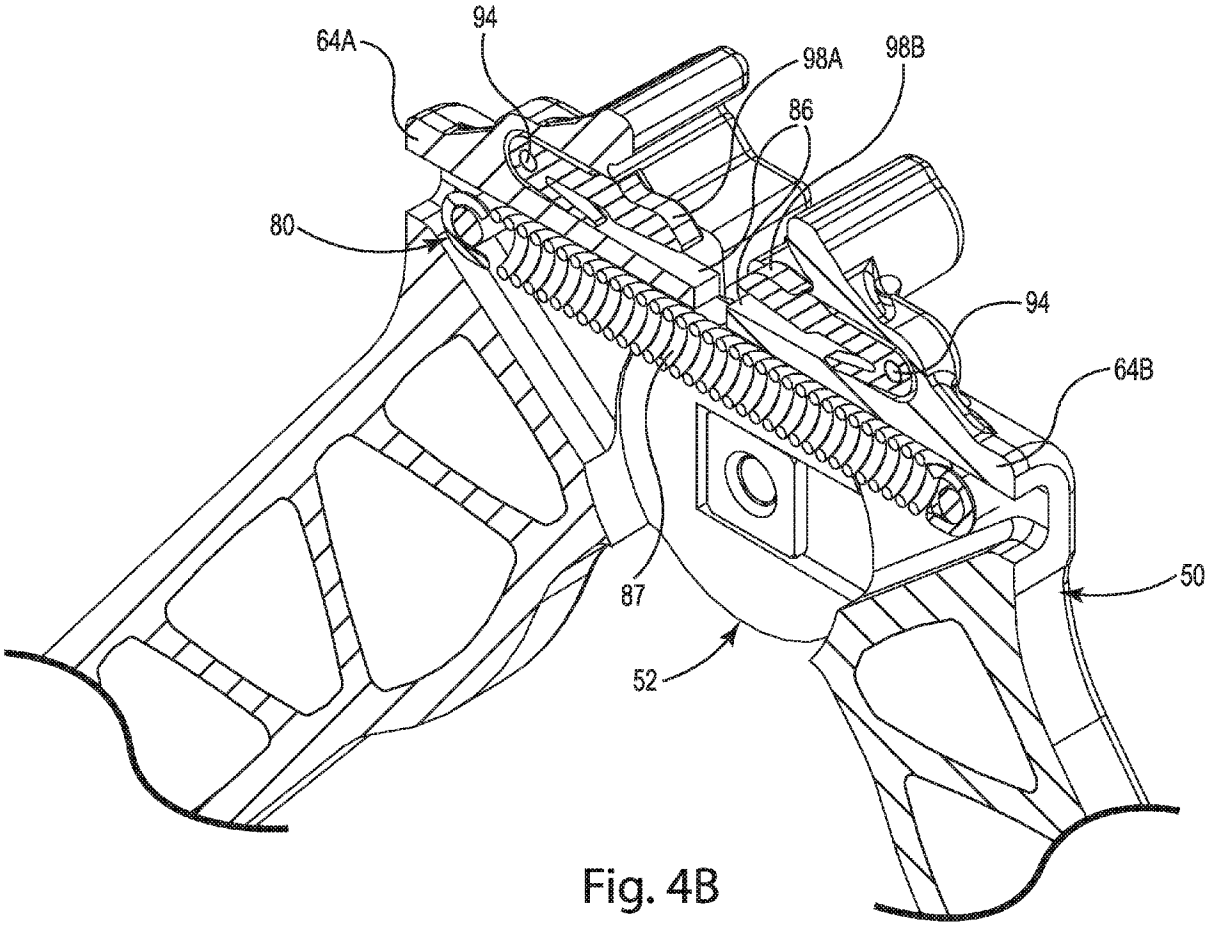

FIGS. 4A and 4B illustrate operation of the biasing mechanism 80 located in the space 81 in the deployed configuration 52. The biasing mechanism 80 is on the same side of the pivot axis 60 as the interface 72. The tension force 83 of the biasing mechanism 80 acting along the axis 82 biases the U-shaped portions 70 toward each other and into engagement with a rail. The tension force 83 is a function of the elongation or displacement 91 of the biasing mechanism 80.

Rail groove engagement members 74A, 74B ("74") are preferably located in recesses 86 adjacent the interface 72 so that engagement features 98A, 98B ("98") can couple with spaced transverse grooves; 104 (see FIG. 5A) in the rail 100. In the preferred embodiment, the rail groove engagement members 74 can be displaced to be completely contained within the recesses 86 so as to not extend into the interface 72. In the illustrate embodiment, the rail groove engagement members 74 are attached to the respective upper portions 64 by pins 94. Flexible fingers 96 act against bottom surfaces of the recesses 86 in the upper portions 64 to bias the engagement features 98A, 98B ("98") into the space defined by the, interface 72. The flexible finger 96 can either be integrally formed (e.g., molded) with the rail groove engagement member 74 or can be a discrete component. In another embodiment the rail groove engagement members 74 do not pivot, but rather are captured in the recesses 86 and slide into and out of engagement with a transverse groove 104.

In an alternate embodiment, the rail groove engagement members 74 are fixed within the interface 72. A user must align the rail groove engagement members 74 with one of the transverse grooves 104 on the rail in order to attach the bipod 50.

Figure 4C:
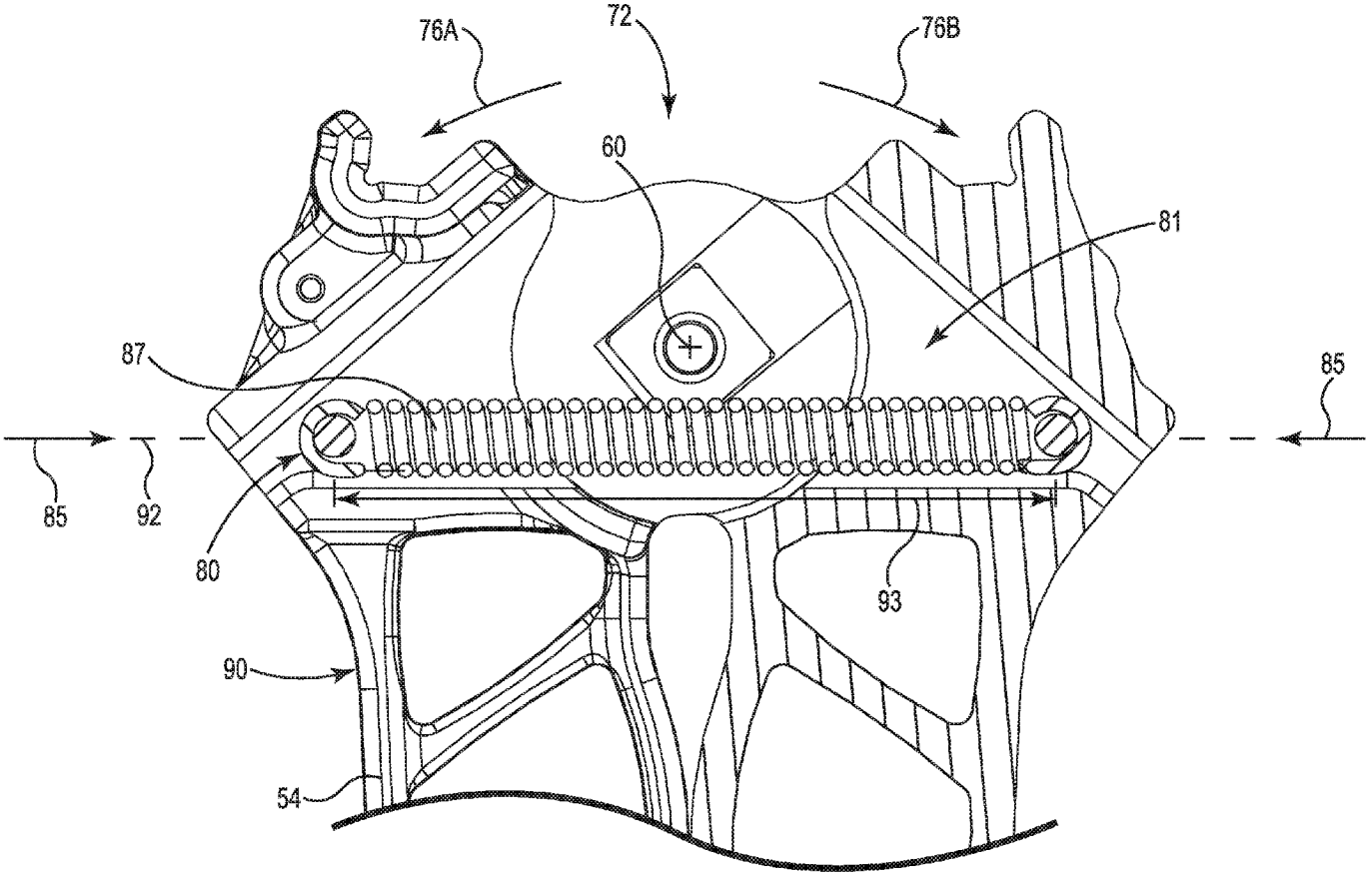
FIG. 4C is a sectional view of the bipod of FIG. 3.

In operation, when the interface 72 is coupled with a rail it is not required for the engagement features 98 to be aligned with one of the transverse grooves 104 (see FIG. 5A) because the rail groove engagement members 74 will merely be pressed into recesses 86 in the upper portions 64. If the bipod 50 is shifted forward or back relative to the rail, however, the engagement features 98 will snap into the first available transverse groove on the rail and prevent the bipod 50 from sliding off the end of the rail, FIG. 4C illustrates an alternate embodiment of the bipod 50 without the rail groove engagement members 74. In the collapsed configuration 90 the biasing mechanism 80 is now repositioned within the space 81 on the opposite side of the pivot axis 60 relative to the interface 72. The tension force 85 supplied by the biasing mechanism 80 acts along the axis 92 to bias the U-shaped portions 70 away from each other in directions 76A. 76B ("76") to release the rail. The tension force 85 is a function of the elongation or displacement 93 of the biasing mechanism 80. The displacement 91 is typically greater than the displacement 93, so the tension force 83 is typically greater than the tension force 85. The biasing mechanism 80 also acts to retain the legs 54 in the collapsed configuration 90 to facilitate handling and storage. Once removed from the shooting device, the bipod 50 automatically shifts to the collapsed configuration 90 and can be easily stored in a pocket.

Figure 5A:
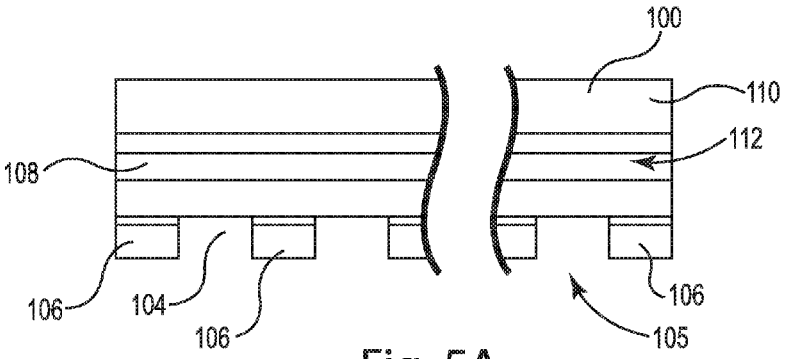
FIG. 5A is a side view of a conventional rail suitable for engagement with a bipod in accordance with an embodiment of the present disclosure.

As illustrated in FIG. 5A, the rail 100 is a long, thin platform having a flattened hexagonal cross-sectional shape 102 and a series of uniformly shaped and spaced transverse grooves 104 separated by ridges 106 located along exposed major surface 105. The ridges 106 can be continuous or discontinuous. Neck portion 108 connects the hexagonal cross-section 102 to base 110 and creates undercuts 112. The base 110 is typically mounted to the underside of a shooting device at a location where a bipod is preferably attached. As used herein, "rail" or "standard rail" refers to a flattened hexagonal cross-sectional member, such as a standard Picatinny or Weaver rail, with alternating transverse grooves and ridges that are attached, directly or indirectly, to a shooting device in order to receive detachable accessories. The rail can be attached directly to a shooting device or can be attached to an intermediate structure which is attached to the shooting device. For example, the rail 100 can be attached to an intermediate device, such as a KeyMod attachment system, which is attached to the shooting device.

Figure 5B:
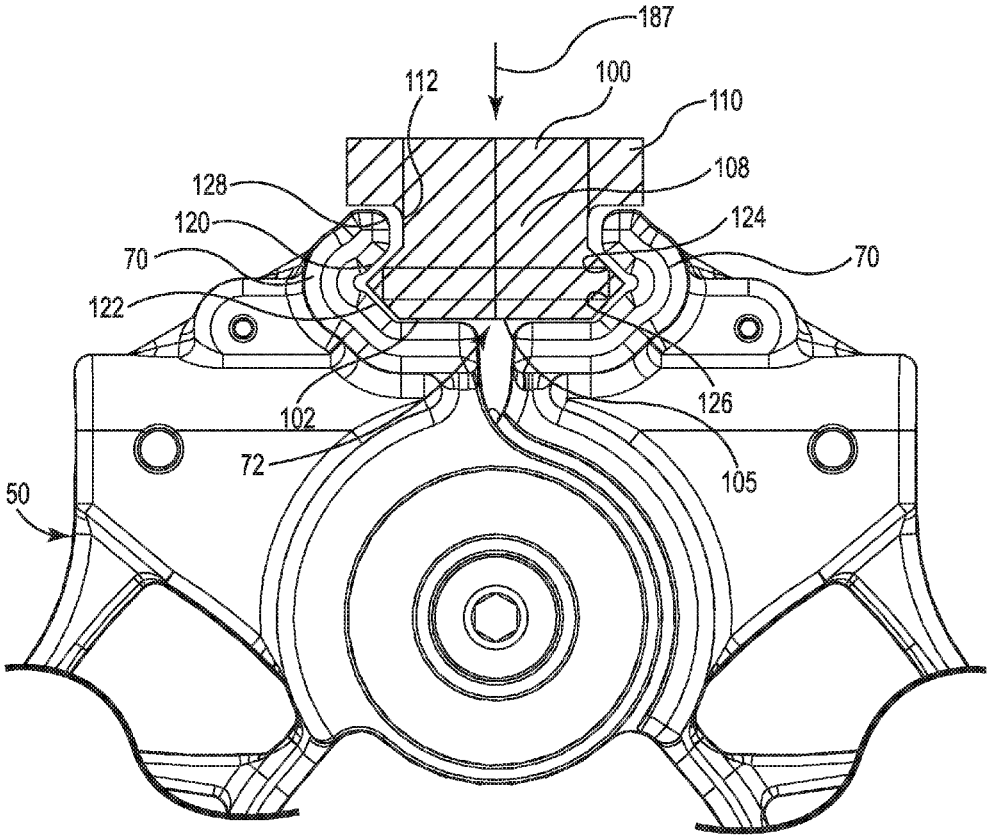
FIG. 5B is a side view of a bipod engaged with the rail of FIG. 5A in accordance with an embodiment of the present disclosure.

FIG. 5B illustrates the bipod 50 coupled with rail 100 in accordance with an embodiment of the present disclosure. The rail groove engagement members 74 are removed to better illustrate the complementary nature of the rail 100 relative to the U-shaped portions 70.

The U-shaped portions 70 include angled surfaces 120, 122 corresponding angled side surfaces 124, 126 on the hexagonal cross-section 102, respectively. Distal portions 128 on the U-shaped portions 70 are configured to reside in the undercuts 112. In the illustrated embodiment, base 110 engages with distal portions 128. In use, the weight of a shooting device applies force 187 onto the rail 100 and the interface 72. The force 187 further biases the U-shaped portions 70 toward each other, supplementing the grip on the rail 100.

Figure 6:
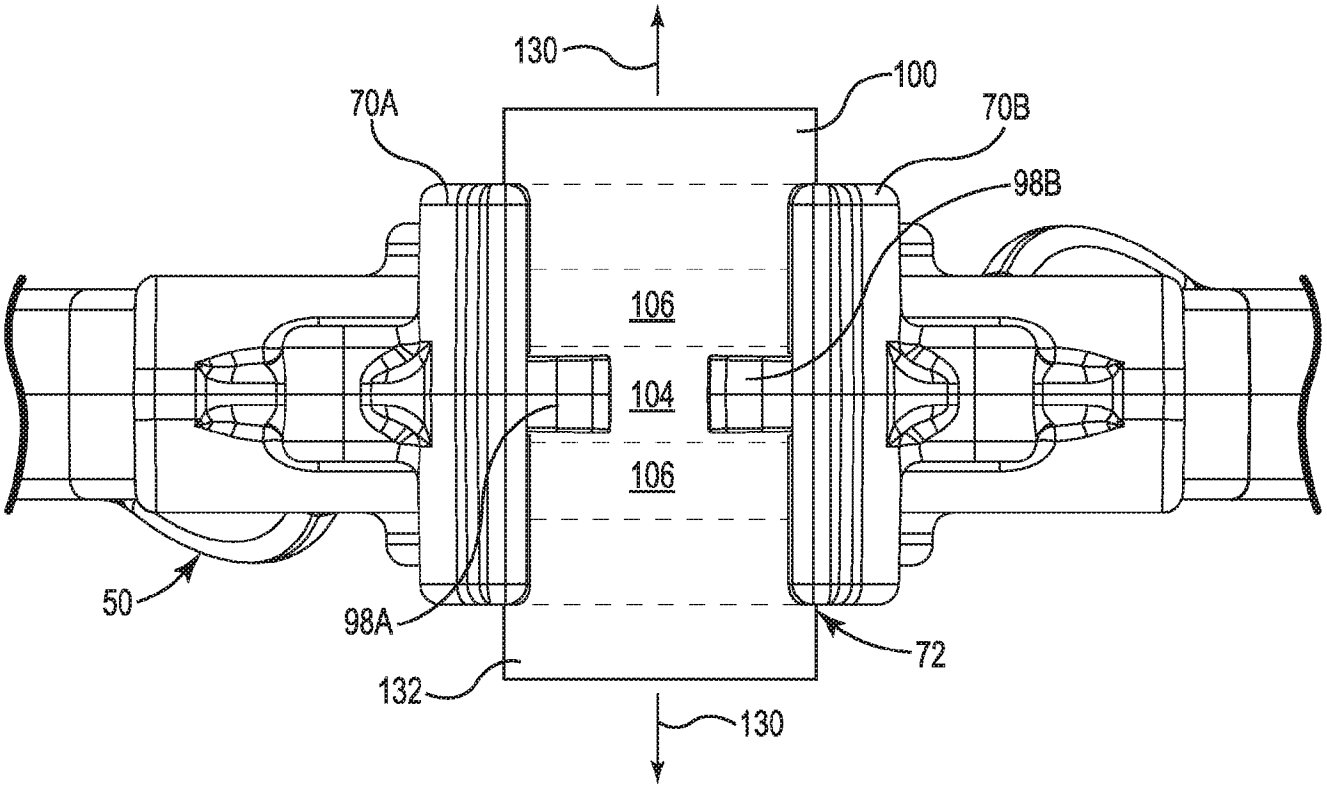
FIG. 6 is a top view of a bipod engaged with the rail of FIG. 5A in accordance with an embodiment of the present disclosure.

FIG. 6 is a top view of the bipod 50 engaged with the rail 100. The engagement features 98 of he rail groove engagement members 74 are engaged with transverse groove 104 at the interface 72. In use, the user engages the U-shaped portions 70 with the rail 100 and then slides the bipod slightly in either direction 130 until the engagement features engage with one of the transverse grooves. The adjacent ridges 106 keep the bipod 50 from sliding longitudinally relative to the rail 100 in either direction along axis 130. The U-shaped portions 70 wrap over surface 124 of the rail 100. Consequently, the rail 100 is captured at the interface 72 in all six degrees of freedom. In one embodiment, the engagement features 98A and 98B are offset so as to engage with adjacent transverse grooves 104.

Figure 7:
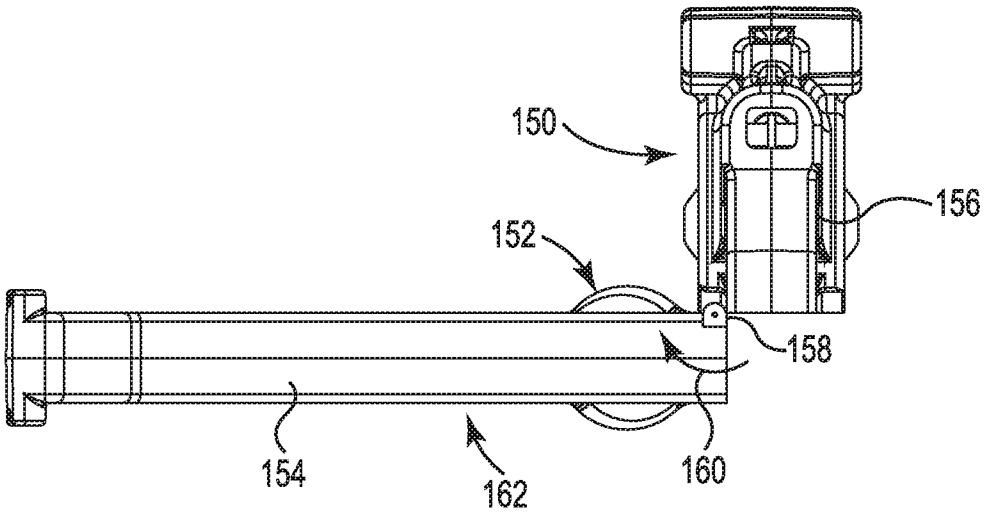
FIG. 7 is a side view of an alternate bipod with folding legs in accordance with an embodiment of the present disclosure.

FIG. 7 illustrates an alternate bipod 150 with folding legs 152 in accordance with an embodiment of the present disclosure. The bipod 150 is substantially the same as illustrated in FIG. 1, except that lower portions 154 of the legs 152 are pivotally attached to the, upper portions 156 by hinge structure 158. The hinge structure 158 permits the lower portions 154 to be folded at least about 90 degrees relative to the upper portions 156. While the bipod 150 is attached to a shooting device (as discussed herein) the lower portions 154 of the legs 152 can be folded in direction 160 to storage position 162.

Figure 8:
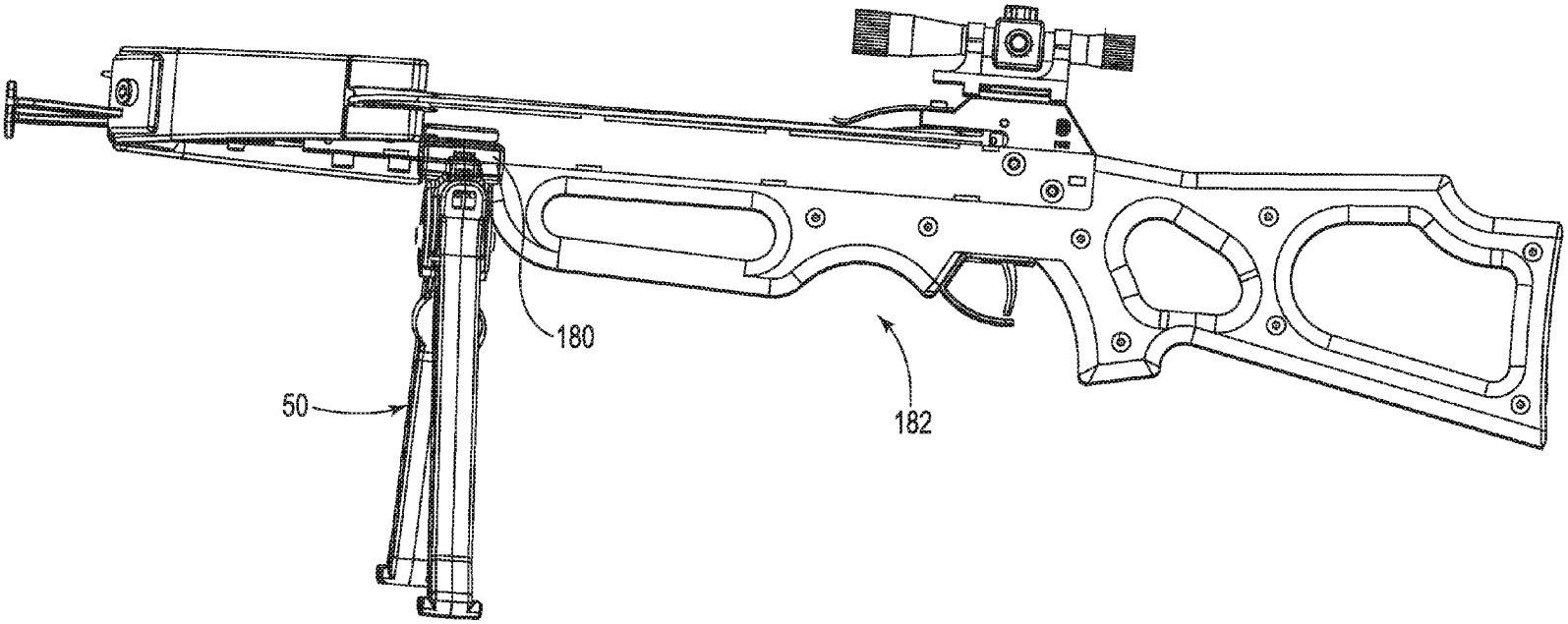
FIG. 8 is a side view of a bipod engaged with a rail of a shooting device in accordance with an embodiment of the present disclosure.

FIG. 8 illustrates the bipod 50 of FIG. 1 coupled a front rail 180 on shooting device 182 in accordance with an embodiment of the present disclosure. In the illustrated embodiment, the shooting device 182 is a crossbow. The weight of the crossbow 182 supplements the tension force of the biasing mechanism 80 to press the U-shaped portions into engagement with the front rail 180. In addition to stabilizing the shooting device 182 during shooting, the bipod 50 can be used for as a support to keep the shooting device 182 off the ground when not in use.

Figure 9:
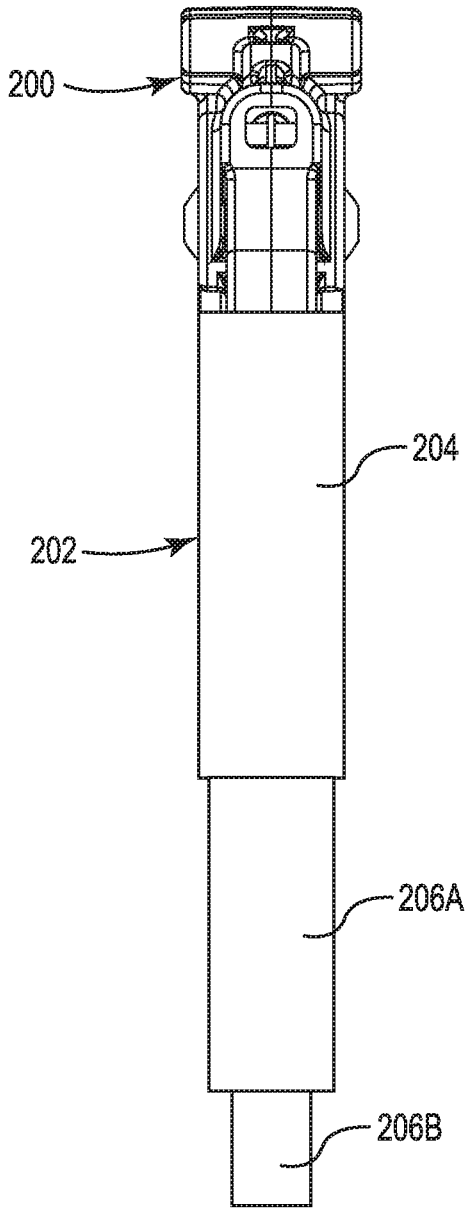
FIG. 9 is a side view of an alternate bipod with telescoping legs in accordance with an embodiment of the present disclosure.

FIG. 9 illustrates an alternate bipod 200 with telescoping legs 202 in accordance with an embodiment of the present disclosure. The bipod 200 is substantially the same as illustrated in FIG. 1, except that lower portions 204 of the legs 202 include a plurality of telescoping sections 206A, 206B ("206"). Various telescoping legs suitable for use on the bipod 200 are disclosed in U.S. Pat. Nos. 6,070,569 (ChalM); U.S. Pat. No. 7,506,846 (Speggiorin); U.S. Pat. No. 7,845,602 (Young); and U.S. Pat. No. 8,161,956 (Bednar), which are hereby incorporated by reference.

Figure 10A:
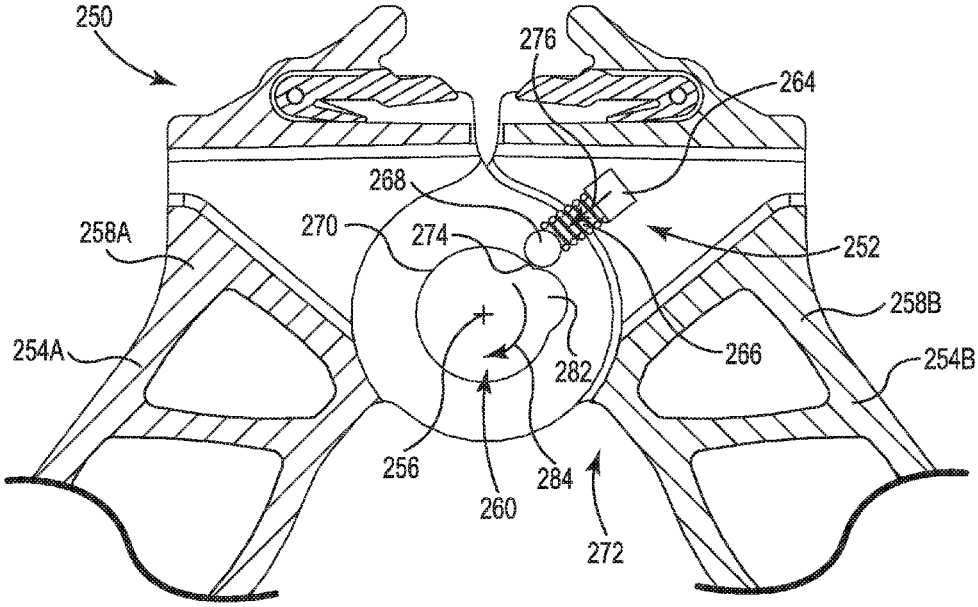
FIGS. 10A-10C illustrate an alternate biasing mechanism for a bipod in accordance with an embodiment of the present disclosure.
Figure 10B:
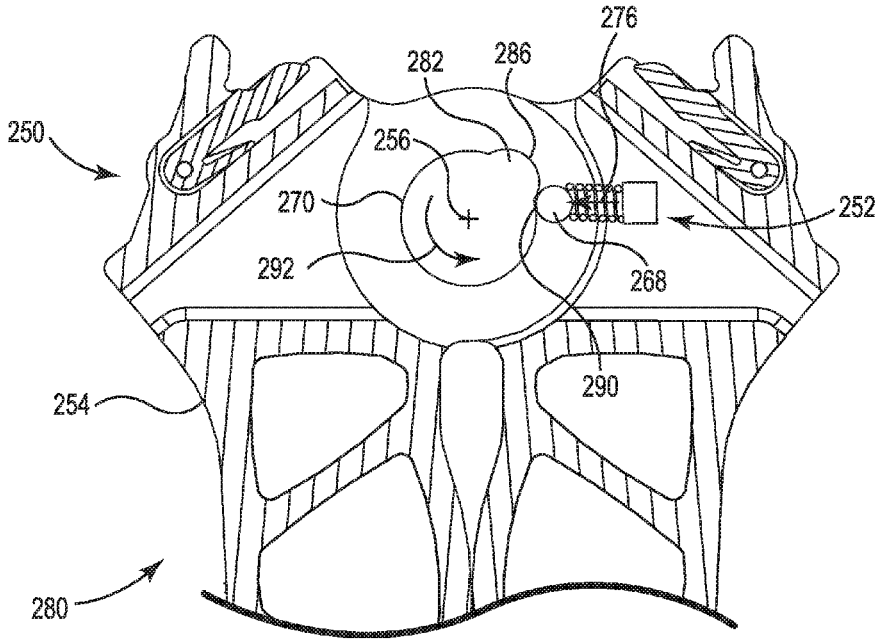

FIGS. 10A and 10B illustrate an alternate bipod 250 with an alternate biasing mechanism 252 in accordance with an embodiment of the present disclosure. The bipod 250 is substantially the same as the bipod 50 illustrate in FIG. 1, except for the biasing mechanism 252.

The legs 254A, 254B ("254") are pivotally attached at pivot axis 256. Upper portion 258A of leg 254A includes cam structure 260 and upper portion 258b of the leg 254B includes biasing mechanism 252.

In the illustrated embodiment the biasing mechanism 252 includes anchor 264 attached to the upper portion 258B that supports compression spring 266. The compression spring 266 includes follower 268 that it presses against cam surface 270. The traveler 268 is preferably a smooth, low friction device. In one embodiment, the follower 268 is a rotating structure such as a ball bearing or rotating shaft.

As best illustrated in FIG. 10A, when the legs 254 are in deployed configuration 272, the spring 266 generates compression force 276 that presses follower 268 into depression 274 on the cam surface 270. The compression force 276 maintains the legs 254 in the deployed configuration 272. In order to move the legs 254 to the collapsed configuration 280 illustrated in FIG. 10B the compression force 276 must be overcome to move the follower 268 over high point or lobe 282 as the cam 260 rotates in direction 284.

Figure 10C:
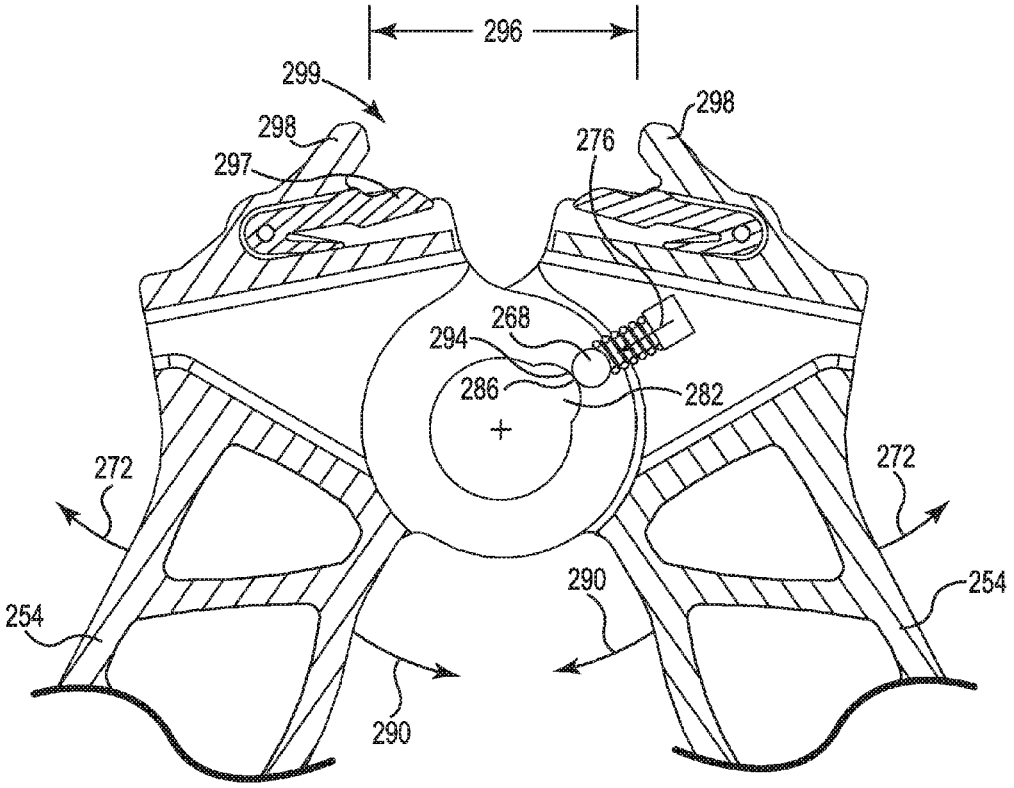

As best illustrated in FIG. 10C, during the transition between the deployed configuration 272 and the collapsed configuration 280 the legs 254 are in an intermediate configuration 300 where the follower 268 is at dead center location 286 on the lobe 282. The compression force 276 generates no net bias toward either the deployed configuration 272 or the collapsed configuration 290. Friction between the lobe 282 and the follower 268 is sufficient to retain the legs 254 in the intermediate configuration 300. The user must provide the force to move the legs 254 toward either the deployed configuration 272 or the collapsed configuration 280. Once the user provides a force to move the biasing mechanism 252 off the dead center position 286 the legs 254 will automatically advance to either the deployed configuration 272 or the collapsed configuration 280, depending on the direction the user selects. In an alternate embodiment, the lobe 282 may optionally include a feature 294 that increases the force required to move the biasing mechanism off the dead center location 286, such as for example a flat surface, a detent, or a high friction surface.

In the intermediate configuration 300, separation 296 between the U-shaped portions 298 is preferably greater than the width of the rail 100 (see e.g., FIG. 5B) so the user can position the interface 299 opposite the rail. Once the user provides a force to move the biasing mechanism 252 off the dead center position 286 the legs 254 will automatically advance to the deployed configuration 272 and the U-shaped portions 298 will automatically engage with the rail 100. The user may then displace the bipod 250 longitudinally along the rail 100 until the rail, groove engagement mechanism 297 snaps into a transverse grooves 104 (see e.g., FIG. 6).

In the collapsed configuration 280 illustrated in FIG. 10B the compression force 276 that presses follower 268 into depression 290 on the cam surface 270. The compression force 276 maintains the legs 254 in the collapsed configuration 280. In order to move the legs 254 to the deployed configuration 272 illustrated in FIG. 10A the compression force 276 must be overcome to move the follower 268 over lobe 282 as the cam 260 rotates in direction 292. In the collapsed configuration 280 the compression force 276 that retains the legs 254 in the collapsed configuration 280.

Figure 11A:
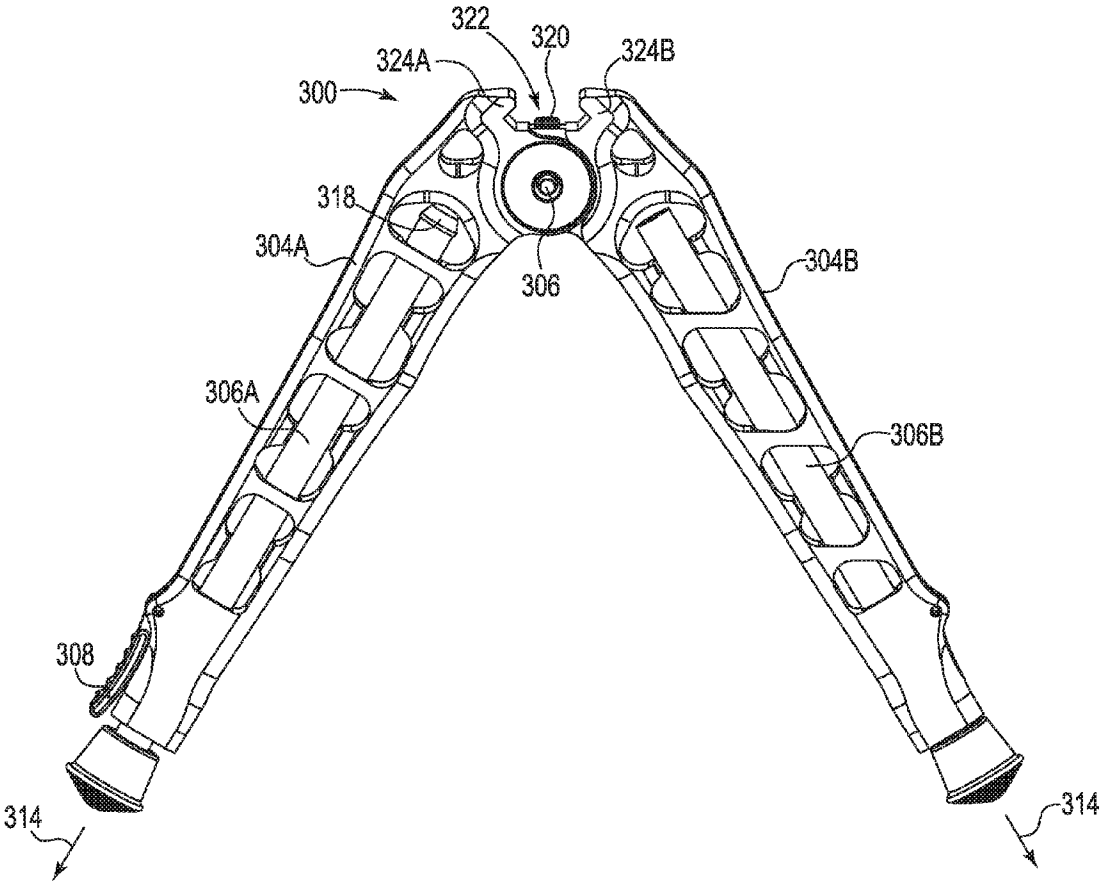
FIG. 11A is a perspective view of an alternate bipod in accordance with an embodiment of the present disclosure.
Figure 11B:
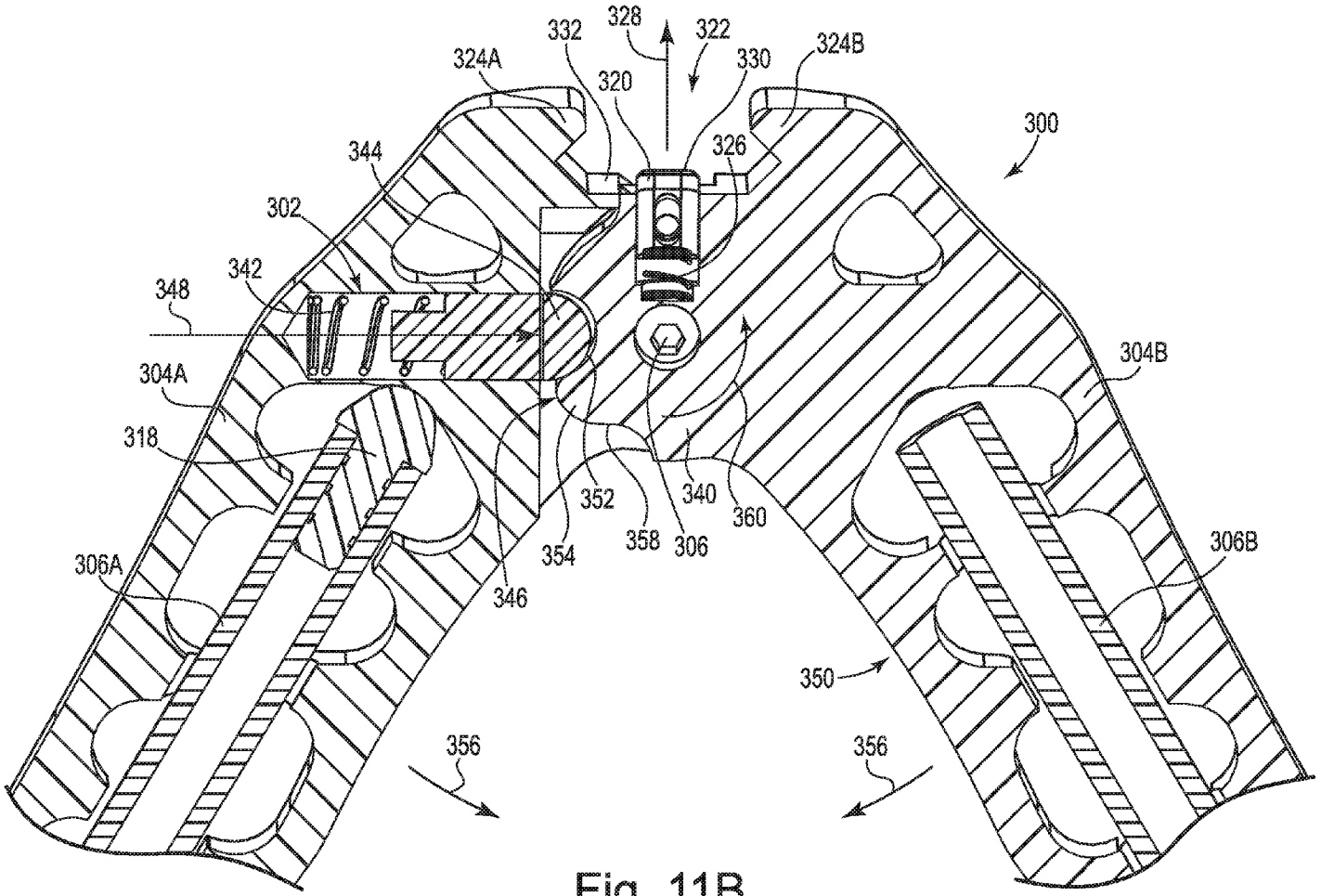
FIG. 11B is a sectional view of the bipod of FIG. 11A.
Figure 11C:
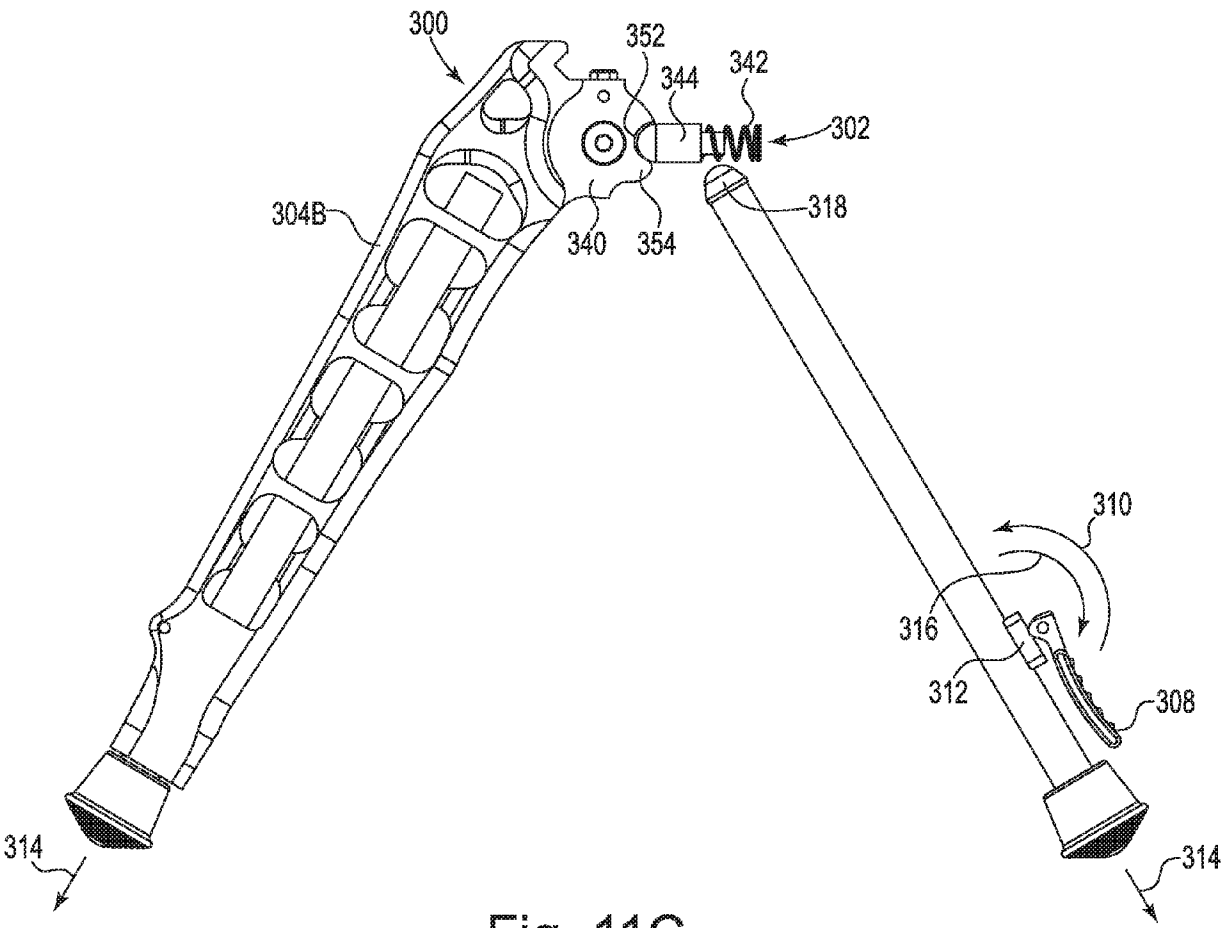
FIG. 11C illustrates the bipod of FIG. 11A with one leg removed.

FIGS. 11A-11C illustrate an alternate bipod 300 with an alternate biasing mechanism 302 in accordance with an embodiment of the present disclosure. The legs 304A, 304B ("304") are pivotally attached at pivot axis 306. Telescoping inserts 306A, 306B ("306") are retained within the legs 304, respectively, by latches 308. The latch 308 is not shown on leg 306B for clarity.

As best illustrated in FIG. 11C, when latch 308 is rotated, in direction 310 pressure applied to friction member 312 is reduced a sufficient amount to permit the telescoping inserts 306 to slid out of legs 304 in direction 314. Rotating the latch 308 in the opposite direction 316 reengages the friction member 312 and locks the telescoping insert 306 in the desired location relative to the leg 304. The telescoping inserts 306 are infinitely adjustable and can be adjusting independently. Caps 318 prevents the telescoping inserts 306 from being, removed from the leg 304.

As best illustrated in FIG. 11B, rail groove engagement member 320 extends into the interface 322 between U-shaped members 324A, 324B ("324"). Spring 326 biases the rail groove engagement member 320 in direction 328. When compressed, top surface 330 of the rail, groove engagement member 320 can sit flush with bottom surface 332 of the interface 322.

The leg 304A includes biasing mechanism 302 and leg 304B includes cam structure 340. In the illustrated embodiment the biasing mechanism 302 includes compression spring 342 that biases follower 344 against cam surface 346. The follower 344 is preferably a smooth, low friction material, such, as nylon.

As best illustrated in FIG. 11B, when the legs 304 are in deployed configuration 350, the spring 342 generates compression force 348 that presses follower 344 into depression 352 on the cam surface 346. The compression force 348 maintains the legs 304 in the deployed configuration 350. In order to move the legs 304 to the collapsed configuration (see e.g., FIG. 3) the compression force 348 must be overcome to move the follower 344 over lobe 354 as the cam structure 340 rotates in direction 360.

During the transition between the deployed configuration 350 and the collapsed configuration the legs 304 are in an intermediate configuration (see e.g., FIG. 10C) where the follower 344 is at the top of the lobe 354, also referred to as a dead center position. The compression force 348 generates no net bias toward either the deployed configuration 350 or the collapsed configuration. The user must provide the force to move the legs 304 toward either the deployed configuration 350 or the collapsed configuration. Once the user provides a force to move the follower 344 off the lobe 354 the legs 304 will automatically advance to either the deployed configuration 350 or the collapsed configuration, depending on the direction the user selects.

In use, the interface 322 is positioned, opposite the, rail with the legs 304 in the intermediate configuration. The user then biases one of the legs toward the deployed configuration 350 and the biasing mechanism 302 automatically couples the U-shaped members 324 to the rail. The user then slides the bipod 300 slightly forward or backward along the rail until the rail groove engagement member 320 snaps into one of the transverse groove on the rail.

In the collapsed configuration the compression force 348 presses the follower 344 into depression 358 on the cam surface 346. The compression force 348 maintains the legs 304 in the collapsed configuration. In order to move the legs 304 to the deployed configuration 350 illustrated in FIG. 11B the compression force 348 must be overcome to move the follower 344 over lobe 354 as the cam structure 340 rotates in direction 360.

Where a range, of values is provided, it is understood that each intervening value, to the tenth of the unit of the lower limit unless the context clearly dictates otherwise, between the upper and lower limit of that range and any other stated or intervening value in that stated range is encompassed within this disclosure. The upper and lower limits of these smaller ranges which may independently be included in the smaller ranges is also encompassed within the disclosure, subject to any specifically excluded limit in the stated range. Where the stated range includes one or both of the limits, ranges excluding either both of those included limits are also included in the disclosure.

Unless defined otherwise, all technical and scientific terms used herein have the same meaning as commonly understood by one of ordinary skill in the art to which this disclosure belongs. Although any methods and materials similar or equivalent to those described herein can also be used in the practice or testing of the various methods and materials are, now described. All patents and publications mentioned herein, including those cited in the Background of the application, are hereby incorporated by reference to disclose and described the methods and/or materials in connection with which the publications are cited.

The publications discussed herein are provided solely for their disclosure prior to the filing date of the present application. Nothing herein is to be construed as an admission that the present disclosure is not entitled to antedate such publication by virtue of prior invention. Further, the dates of publication provided may be different from the actual publication dates which may need to be independently confirmed.

Other embodiments are possible. Although the description above contains much specificity, these should not be construed as limiting the scope of the disclosure, but as merely providing illustrations of some of the presently preferred embodiments. It is also contemplated that various combinations or sub-combinations of the specific features and aspects of the embodiments may be made and still fall within the scope of this disclosure. It should be understood that various features and aspects of the disclosed embodiments can be combined with or substituted for one another in order to form varying modes disclosed. Thus, it is intended that the scope of at least some of the present disclosure should not be limited by the particular disclosed embodiments described above.

Thus the scope of this disclosure should be determined by the appended claims and their legal equivalents. Therefore, it will be appreciated that the scope of the present disclosure fully encompasses other embodiments which may become obvious to those skilled in the art, and that the scope of the present disclosure is accordingly to be limited by nothing other than the appended claims, in which reference to an element in the singular is not intended to mean "one and only one" unless explicitly so stated, but rather "one or more." All structural, chemical, and functional equivalents to the elements of the above-described, preferred embodiment that are known to those of ordinary skill in the art are expressly incorporated herein by reference and are intended to be encompassed by the present claims. Moreover, it is not necessary for a device or method to address each and every problem sought to be solved by the present disclosure, for it to be encompassed by the present claims. Furthermore, no element, component, or method step in the, present disclosure is intended to be dedicated to the public regardless of whether the element, component, or method step is explicitly recited in the claims.

What is claimed is:

1. A bipod with a quick connect feature that engages with a standard rail having a generally flattened hexagonal cross-sectional shape with alternating transverse grooves and ridges located along an exposed major surface, the bipod comprising:

a pair of legs pivotally attached at a pivot axis, each of the legs having upper portions and lower portions located on opposite side of the pivot axis, the legs moveable between a deployed configuration with the lower portions separated and the upper portions proximate each other, and a collapsed configuration with the lower portions proximate each other and the upper portions separated;

U-shaped portions located at the upper portions of the legs that form an interface with the standard rail when the legs are in a deployed configuration; and a biasing mechanism coupled to the legs having a dead center position when the legs are in an intermediate configuration between the deployed configuration and the collapsed configuration, such that the biasing mechanism does not bias the legs toward either the deployed configuration or the collapsed configuration when in the dead center position, wherein shifting the biasing mechanism to one side of the dead center position automatically biases the legs toward the deployed configuration, and shifting the biasing mechanism to an opposite side of the dead center position automatically biases the legs toward the collapsed configuration;

wherein the biasing mechanism maintains the interface with the rail when in the deployed configuration and retains the lower portions of the legs adjacent each other in the collapsed configuration.

2. The bipod of claim 1 comprising at least one rail groove engagement member located at the interface to couple with a transverse groove in the standard rail.

3. The bipod of claim 1 comprising at least one rail groove engagement member configured to couple with a transverse groove in the standard rail members biased into the interface.

4. The bipod of claim 3 wherein the at least one rail groove engagement member is positioned flush with a lower surface of the interface when compressed.

5. The bipod of claim 1 comprising:

at least one recess in one of the upper portions of the legs adjacent the interface; and at least one rail groove engagement members located in the recess that is biased into the interface to selectively couple with a transverse groove in the standard rail.

6. The bipod of claim 5 wherein the rail groove engagement member is pivotally attached to the upper portion in the recess.

7. The bipod of claim 5 comprising a biasing mechanism integrally formed in the rail groove engagement member.

8. The bipod of claim 1 comprising:

a recess adjacent the interface in each of the upper portions of the legs; and a rail groove engagement member located in each of the recess that is biased into the interface to selectively couple with a transverse groove in the standard rail.

9. The bipod of claim 1 wherein lower portions of the legs are telescopically extendable.

10. The bipod of claim 1 comprising:

telescoping inserts located in each of the legs; and a latch that retains the telescoping inserts in a variety of extended configurations.

11. The bipod of claim 10 wherein the telescoping inserts are infinitely adjustable relative to the legs.

12. The bipod of claim 1 wherein lower portions of the legs comprise a hinge that permits the lower portions to be folded at least 90 degrees relative to the upper portions.

13. The bipod of claim 1 wherein the biasing mechanism is located in recesses formed in the upper portions of the legs.

14. The bipod of claim 13 wherein the cam structure comprises a high point or lobe that engages with the cam follower when the biasing mechanism is in the dead center position and the legs are in the intermediate configuration.

15. The bipod of claim 1 wherein the biasing mechanism provides one of a tension force or a compression force to bias the legs to either the deployed configuration or the collapsed configuration.

16. The bipod of claim 1 wherein the biasing mechanism comprises a cam structure coupled to one leg and a cam follower biased against the cam structure coupled to the other leg.

17. The bipod of claim 1 wherein the biasing mechanism comprises a cam structure coupled to one leg and a cam follower biased against the cam structure coupled to the other leg, the cam structuring comprising a feature that increases a force required to move the biasing mechanism off the dead center location.

18. The bipod of claim 1 wherein the biasing mechanism comprises a spring pivotally attached to the upper portions of each of the legs at attachment points that shift between opposite sides of the pivot axis when in the deployed configuration or the collapsed configuration, the spring providing a first tension force located between the interface and the pivot axis when in the deployed configuration, and a second tension force located on the opposite side of the pivot axis from the interface when in the collapsed configuration.

19. A bipod with a quick connect feature that engages with a standard rail having a generally flattened hexagonal cross-sectional shape with alternating transverse grooves and ridges located along an exposed major surface, the bipod comprising:

a pair of legs pivotally attached at a pivot axis, each of the legs having upper portions and lower portions located on opposite side of the pivot axis, the legs moveable between a deployed configuration with the lower portions separated and the upper portions proximate each other, and a collapsed configuration with the lower portions proximate each other and the upper portions separated;

U-shaped portions located at the upper portions of the legs that form an interface with the standard rail when the legs are in a deployed configuration; and a spring pivotally attached to the upper portions of each of the legs at attachment points that shift between opposite sides of the pivot axis when in the deployed configuration or the collapsed configuration, the spring providing;

a first tension force located between the interface and the pivot axis when in the deployed configuration; and a second tension force located on the opposite side of the pivot axis from the interface when in the collapsed configuration;

wherein the first tension force biasing the U-shaped portions toward each other and into engagement with the rail when in the deployed configuration, and the second tension force biasing the U-shaped portions away from each other and retaining the lower portions of the legs adjacent each other in the collapsed configuration;

wherein the spring comprises a dead center position when the legs are in an intermediate configuration between the deployed configuration and the collapsed configuration, such that the spring does not bias the legs toward either the deployed configuration or the collapsed configuration when in the dead center position, wherein shifting the spring to one side of the dead center position automatically biases the legs toward the deployed configuration, and shifting the spring to an opposite side of the dead center position automatically biases the legs toward the collapsed configuration.

20. A bipod with a quick connect feature that engages with a standard rail having a generally flattened hexagonal cross-sectional shape with alternating transverse grooves and ridges located along an exposed major surface, the bipod comprising:

a pair of legs pivotally attached at a pivot axis, each of the legs having upper portions and lower portions located on opposite, side of the pivot axis, the legs moveable between a deployed configuration with the lower portions separated and the upper portions proximate each other, and a collapsed configuration with the lower portions proximate each other and the upper portions separated;

U-shaped portions located at the upper portions of the legs that form an interface with the standard rail when the legs are in a deployed configuration; and a spring located pivotally attached to the upper portions of each of the legs that provides first and second tension forces along axes that shifts to opposite sides of the pivot axis when in the deployed configuration or the collapsed configuration, respectively, the spring providing a first tension force along an axis located between the interface and the pivot axis when in the deployed configuration, and a second tension force along an axis located on the opposite side of the pivot axis from the interface when in the collapsed configuration, the first tension force biasing the U-shaped portions toward each other and into engagement with the rail when in the deployed configuration, and the second tension force biasing the U-shaped portions away from each other and retaining the lower portions of the legs adjacent each other in the collapsed configuration;

wherein the spring comprises a dead center position when the legs are in an intermediate configuration between the deployed configuration and the collapsed configuration, such that the spring does not bias the legs toward either the deployed configuration or the collapsed configuration when in the dead center position, wherein shifting the spring to one side of the dead center position automatically biases the legs toward the deployed configuration, and shifting the spring to an opposite side of the dead center position automatically biases the legs toward the collapsed configuration.

* * * * *